US008024906B1

(12) United States Patent
Nelson et al.

(10) Patent No.: US 8,024,906 B1
(45) Date of Patent: Sep. 27, 2011

(54) STANDING-SEAM ROOF ASSEMBLY BRACKET

(75) Inventors: Dale G. Nelson, Odessa, FL (US); Duane V. McConnohie, Tampa, FL (US)

(73) Assignee: Roof Hugger, Inc., Lutz, FL (US)

( * ) Notice: Subject to any disclaimer, the term of this patent is extended or adjusted under 35 U.S.C. 154(b) by 121 days.

(21) Appl. No.: 12/168,528

(22) Filed: Jul. 7, 2008

Related U.S. Application Data

(60) Provisional application No. 60/948,295, filed on Jul. 6, 2007.

(51) Int. Cl.
*E04B 1/00* (2006.01)

(52) U.S. Cl. ..... 52/745.06; 52/410; 52/478; 52/551; 52/846

(58) Field of Classification Search ..... 52/90.2, 52/408, 409, 410, 478, 481.1, 483.1, 489.1, 52/508, 520, 537, 712, FOR. 126, FOR. 133, 52/FOR. 139, 745.06, 551, 846
See application file for complete search history.

(56) References Cited

U.S. PATENT DOCUMENTS

| | | | | |
|---|---|---|---|---|
| 3,998,019 | A * | 12/1976 | Reinwall, Jr. | 52/478 |
| 4,047,346 | A * | 9/1977 | Alderman | 52/407.4 |
| 4,075,806 | A * | 2/1978 | Alderman | 52/90.1 |
| 4,495,743 | A * | 1/1985 | Ellison et al. | 52/478 |
| 4,649,684 | A * | 3/1987 | Petree et al. | 52/395 |
| 5,367,848 | A | 11/1994 | McConnohie | |
| 5,390,457 | A * | 2/1995 | Sjolander | 52/387 |
| 5,511,354 | A | 4/1996 | Eidson | |
| 5,875,592 | A | 3/1999 | Allman et al. | |
| 6,141,932 | A | 11/2000 | Tarrant | |
| 6,185,824 | B1 * | 2/2001 | McClure et al. | 30/229 |
| 6,401,412 | B1 | 6/2002 | Cooper | |
| 6,470,644 | B2 | 10/2002 | James et al. | |
| 6,715,256 | B1 * | 4/2004 | Fischer | 52/713 |
| 7,174,686 | B1 * | 2/2007 | Legband | 52/471 |
| 7,313,893 | B2 * | 1/2008 | Voegele, Jr. | 52/461 |

FOREIGN PATENT DOCUMENTS

| | | | |
|---|---|---|---|
| GB | 2230284 A | * | 10/1990 |
| JP | 03115649 A | * | 5/1991 |

* cited by examiner

*Primary Examiner* — Brian Glessner
*Assistant Examiner* — Adriana Figueroa
(74) *Attorney, Agent, or Firm* — Innovus Law Group; Thomas E. Toner

(57) ABSTRACT

A bracket for use in retro-fitting metal clad buildings to facilitate attachment of new roof or wall panels of any desired profile, directly over existing ribbed or fluted panels of various configurations. Commonly known in the trades as a sub purlin or sub girt. Generally a one piece Z shaped metal bracket with a substantially vertical web between opposed top and bottom flanges in a parallel plane. The bottom flange and adjacent lower portion of the web contain a series of notches that allow the bracket to nest onto and over existing ribbed roof or wall panels. The top flange is automatically in position, lying flat and continuous, to receive and attach the new panels thereto. An ant-roll tab further connects the web to the existing roof panel. The solid portion of lower flange is preferred to be positioned directly above the underlying substructural support system members of the existing building to assure a structurally sound attachment of bracket to the building. Pre-punched holes in the solid portion of lower flange dictate required location, number and size of fasteners to be inserted through lower rib surface of existing panel into substructural system members.

14 Claims, 7 Drawing Sheets

STANDING-SEAM ROOF ASSEMBLY BRACKET

CROSS-REFERENCE TO RELATED APPLICATIONS

This application is a nonprovisional application of U.S. provisional patent application Ser. No. 60/948,295, filed Jul. 6, 2008.

FIELD OF INVENTION

The present invention relates generally to metal building structures: Specifically to the retro-fitting of new roof and/or wall panels over existing ribbed, fluted, profiled or standing seam roof and/or wall panels.

BACKGROUND OF THE INVENTION

A metal building, generally, is a lightweight structure consisting of vertical steel columns, steel rafter beams bolted to the vertical columns and generally spaced from 20 to 30 feet apart. The rafter beams are generally sloped to provide positive drainage. Spanning the columns and rafter beams at sidewalls and roof are a series of light gauge sub-structural "z" or "c" sections bolted to the columns and rafter beams. These are generally on 4' to 5' spacing and run perpendicular to the columns and rafter beams, commonly known in the trade as purlins for roof support and girts for sidewall support.

Covering the structural system are ribbed, fluted, standing seam or profiled panels with alternating higher ribs and flat valleys or pans generally with high rib being 6" to 24" on center and valleys being 4" to 18" across the flat and of generally 26 gauge or 24 gauge sheet metal, creating a structural diaphragm when fastened to the substructural system. Such higher rib surface's lie substantially in an upper plane and the bottom valley or pan surfaces lie substantially in a lower plane spaced apart from the upper plane. The alternating top and bottom surfaces are interconnected by a series of webs extending parallel to the longitudinal axis of the formed panel diaphragm.

There are an infinite variety of shapes of such configurations commercially available. For simple reference refer to the top surface as being the top plane of the higher rib and base surface as being the lower plane of the low rib. The web being the connecting form of the two. The panels are generally attached to the aforesaid sub-structural members with generally a series of threaded screws, generally 12" or less on center for the entire building length. Standing seam type roofing is attached to the sub-structural members by means of clips mounted on the sub-structural members. Certain installations of these panels separate the panels from the sub-structure by a distance of ½" to 6" to improve the thermal qualities of the roof and/or wall system. These assemblies are difficult and in some cases impossible to retrofit because of the problem of providing a solid, stable retrofit sub-framing system due to the compressibility of the insulating material or gap between the roof panel and sub-structure.

The design of metal building structures optimizes minimum weight materials to work in unison in meeting the building code requirements for wind, snow, ice and live loading for the many geographical location's exposure to the elements. In achieving that criteria, each component is engineered to meet the requirements of the codes.

In re-roofing of such structures, extreme attention is given to limiting imposition of further dead loads on the original structural design and yet to resist the full wind uplift requirements of multiple building codes.

SUMMARY OF INVENTION

In an exemplary embodiment, the invention includes a bracket with configured cut-outs in the lower flange and web section that nest in close proximity to the existing standing seam roof so that a strong and proper connection to the structure can be readily achieved. The vertical web may vary in height to accommodate additional insulation, utilities or other accessories in the space between the two panels. The upper flange has ample width and strength to receive various means of attachment of the new roof panels. The bracket also includes pre-punched holes in the lower flange to properly pre-locate fasteners and prevent the lower flange from riding up on the fastener shank during installation which can result in an inadequate connection.

The bracket also includes an anti-roll tab adjacent the cut-outs which are attached to the existing roof panel. The anti-roll tabs can be bent in the field to contact the existing roof panel, providing a versatile, adaptable and stable bracket readily configured to the many variations of panel profiles now existing in the field. The bracket can be installed over panels the have a compressible substrate beneath them. The invention, therefore, provides a flexible, stable bracket shaped to absorb distortion forces of thermal expansion and contraction of the panels and their loads resulting from wind forces or seismic disturbance, while also providing a structurally correct attachment surface for the new roof and/or wall panels Accordingly, it is one object of the present invention to provide a product and means to the metal building industry to enable retro fitting of new roof or wall panels over existing roof or wall panels without the necessity of removal of existing panels. Such product and means to also meet criteria demanded by building codes.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
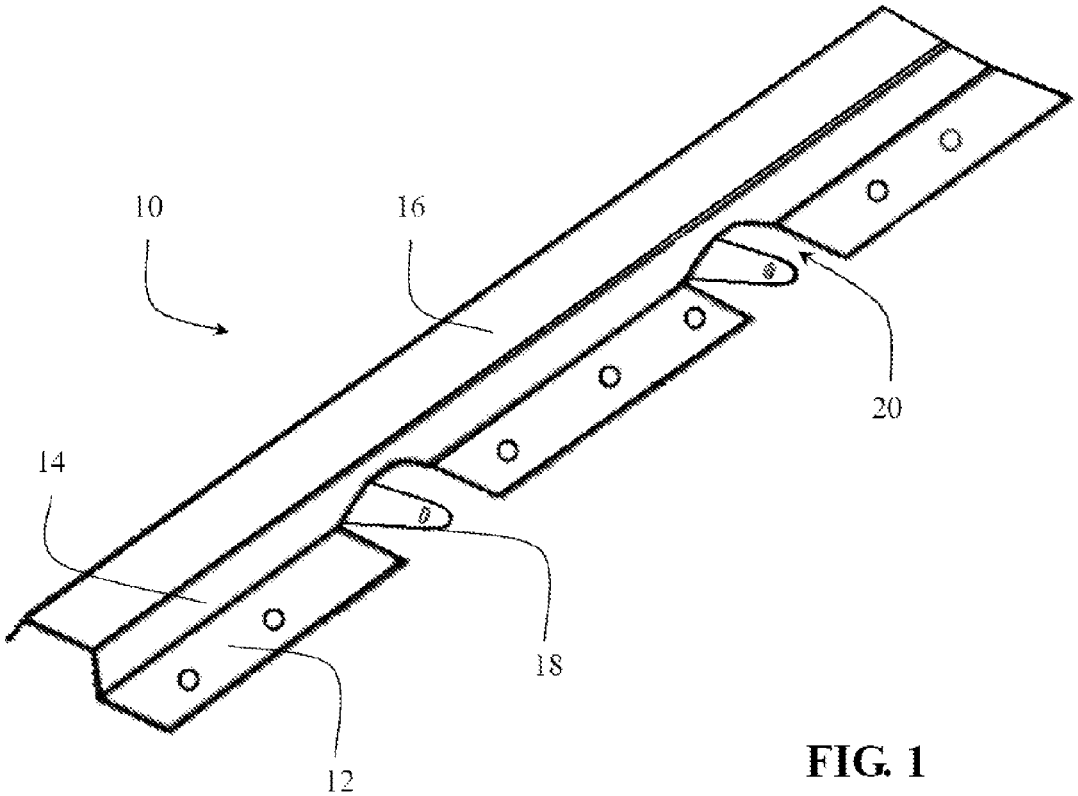
FIG. 1 is an isometric view of the inventive bracket.
Figure 2:
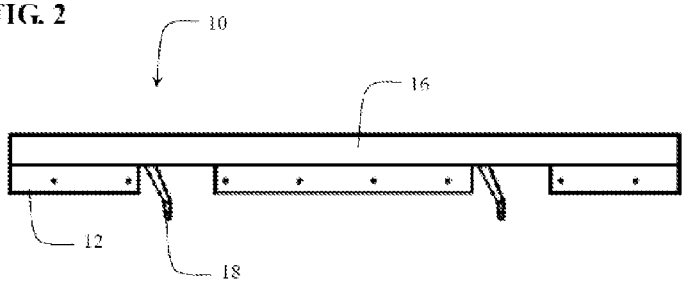
FIG. 2 is a top plan view of a bracket of one embodiment of the invention.
Figure 3:
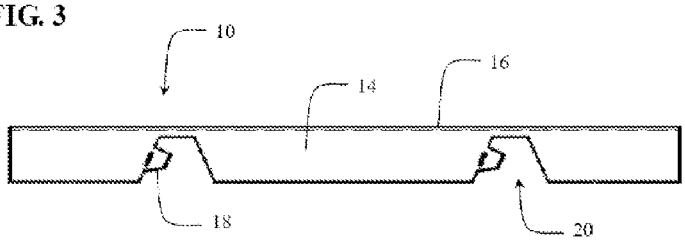
FIG. 3 is a side plan view of a bracket of one embodiment of the invention.
Figure 4:
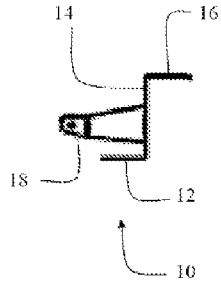
FIG. 4 is a front plan view of a bracket of one embodiment of the invention.
Figure 5A:
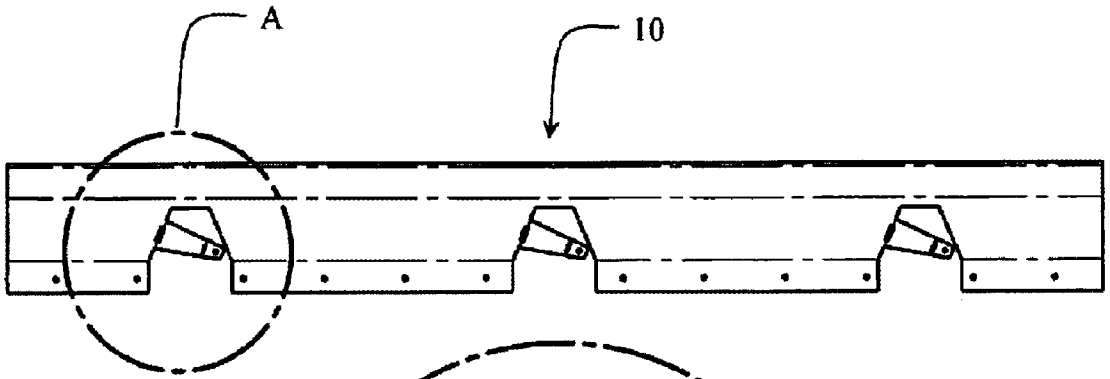
FIG. 5A is a side plan view showing section A.
Figure 5B:
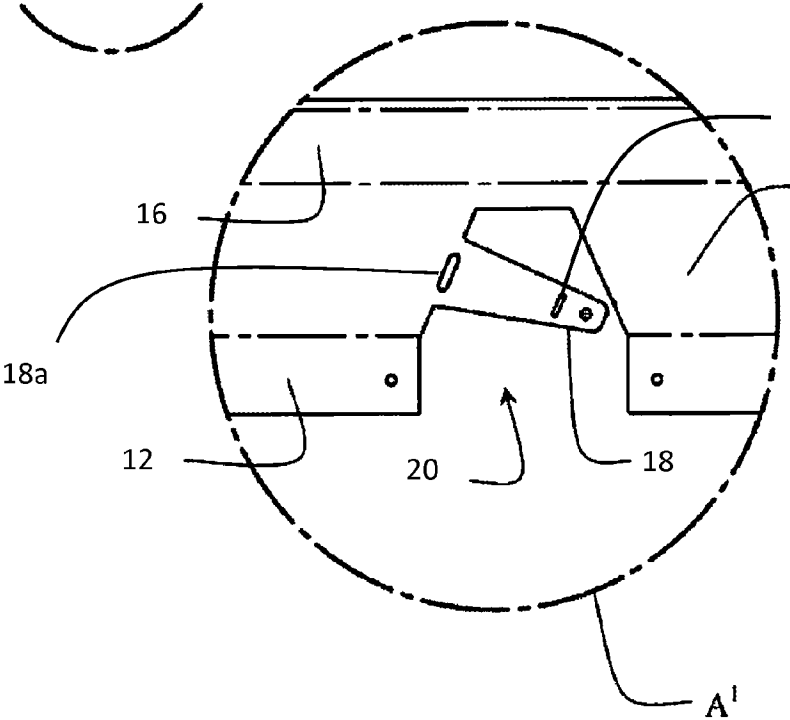
FIG. 5B is a detail of section A of FIG. 5.

Shown in FIGS. 1-5B, the invention includes bracket 10 for re-roofing a standing seam roof, otherwise known as a sub-purlin, having an anti-roll bracing arm. The bracket of one embodiment attaches to the existing high clip metal standing seam roof panel. It is contemplated that the bracket 10 can be fabricated from nearly any material from which building panels are fabricated. Such materials are easily fabricated into one of any number of shapes and sizes, depending on the particular system requirements.

In one embodiment, the bracket is substantially Z-shaped. The bracket of this embodiment includes generally vertical web 14 between a lower 12 and upper flanges 16. Web 12 has a number of cut-outs 20 along its length which receive the contour of the existing roof panels. Anti-roll arm 18, positioned adjacent cut-outs 20, is then pressed into contact with and fastened to the existing roof panel. Anti-roll arm 18 prevents the bracket and new roof from lateral movement with respect to the existing building panel.

Bracket 10 can be used with existing building panels having nearly any profile. As shown in FIGS. 6A-8, cut-outs 20 formed in web 12 are selectively shaped to match ribs 33 of existing building panel 32. This permits the bracket to substantially engage the surface of the existing building panel. Lower flange 12 is shaped and sized to substantially correspond with existing purlin 36, to which existing building panel 30 is affixed.

Figure 6A:
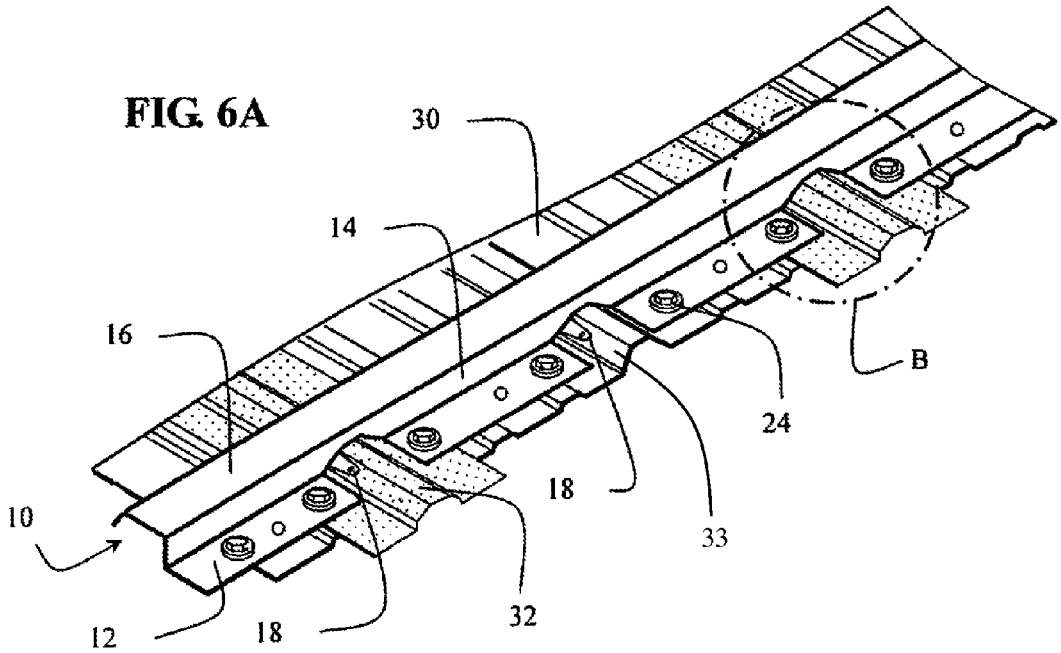
FIG. 6A is a perspective view of the inventive bracket installed on an existing roof.
Figure 6B:
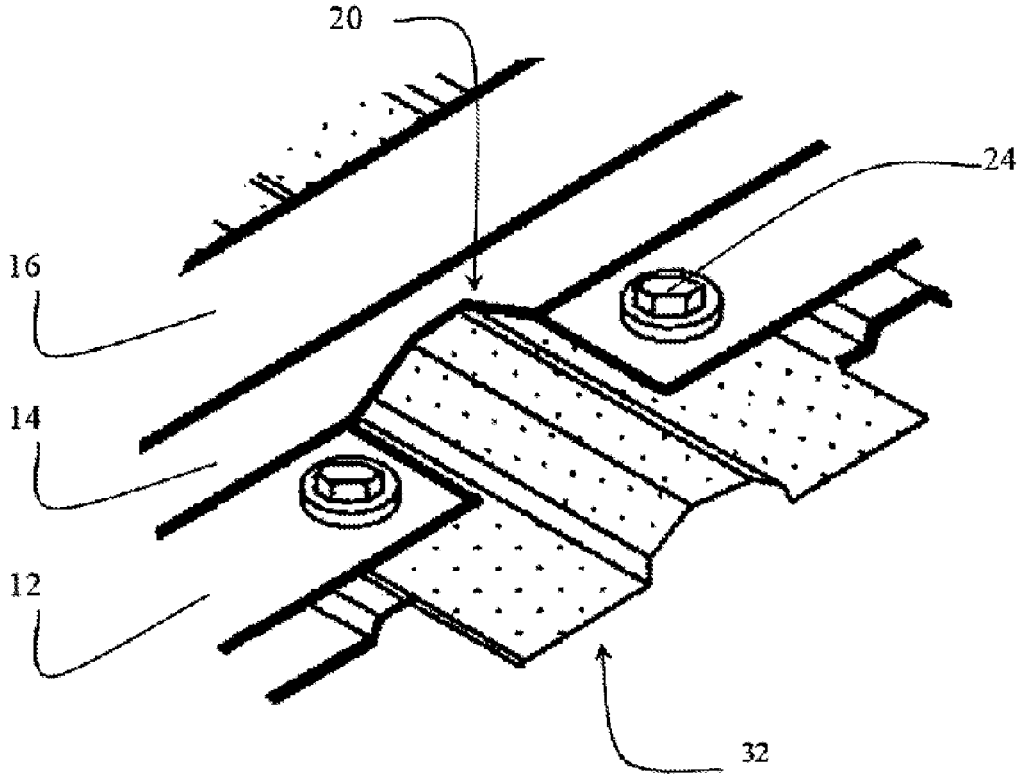
FIG. 6B is a detail of section B of FIG. 6A.
Figure 7:
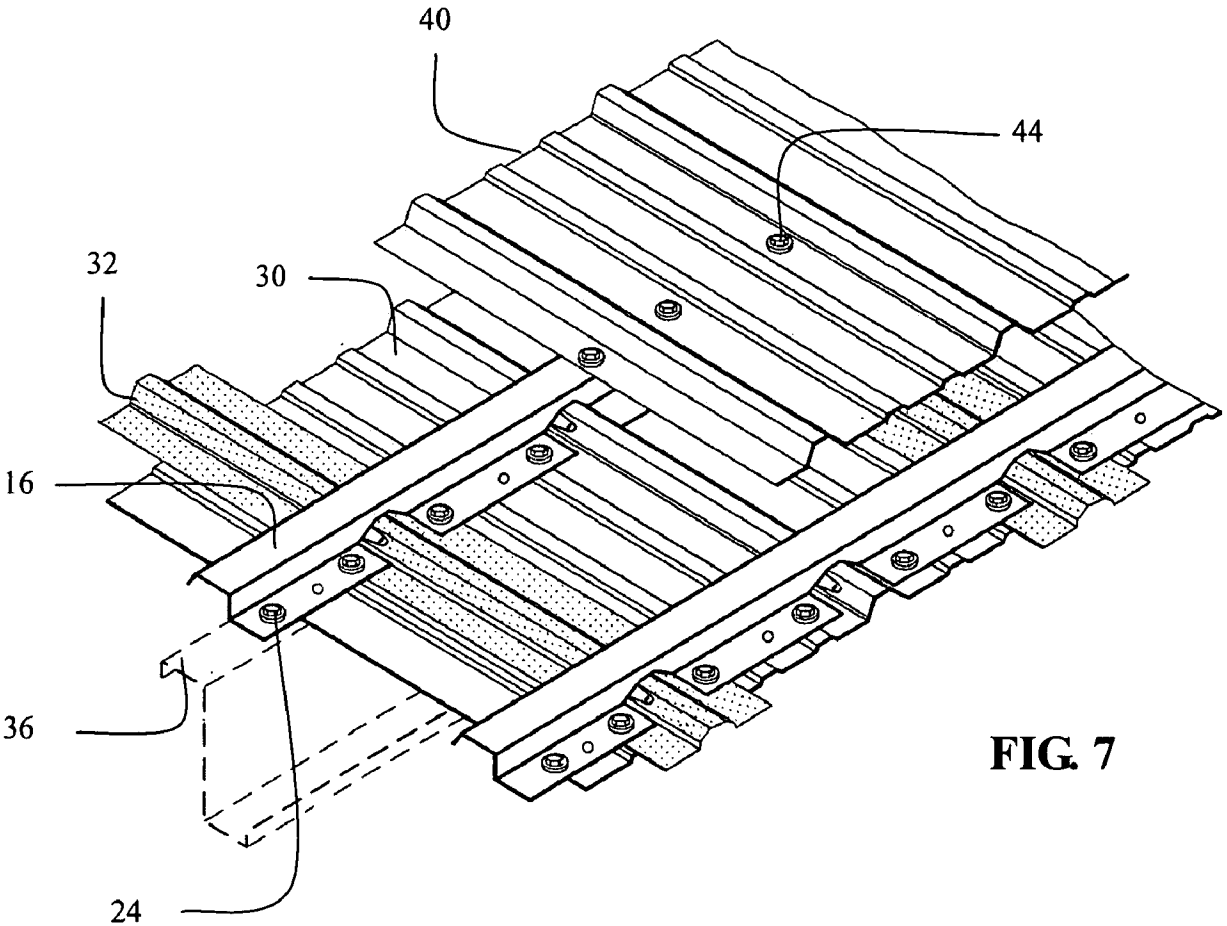
FIG. 7 is a perspective view of the inventive bracket, installed on an existing roof, with new roof panels attached thereto.
Figure 8:
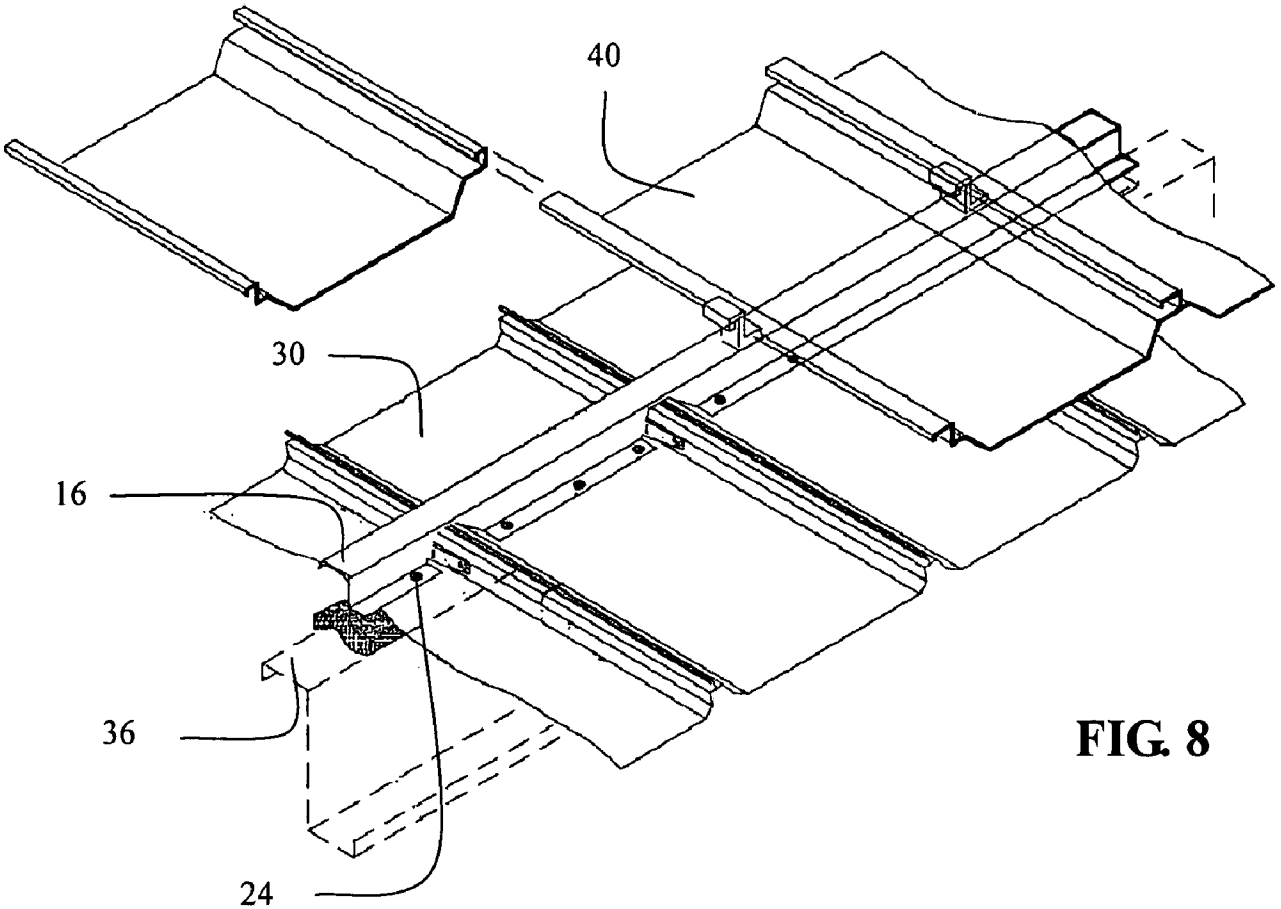
FIG. 8 is a perspective view of the inventive bracket, installed on an existing roof, with new roof panels attached thereto.

FIGS. 6A-7 show an embodiment which includes the use of optional hat channel 32. A first plurality of fasteners 24 secures the bracket to existing purlin 36, with existing roof 30 and hat channel 32 there between. New building panel 40 is attached to upper flange 16 of bracket 10 with a plurality of fasteners 44.

In use, bracket 10 is installed directly above existing purlin 36. In some cases, depending on the required wind uplift resistance; some local reinforcement may be required. Bracket 10 is laid directly above purlin 36, across the existing roof panel 30. Once bracket 10 is properly positioned, anti-roll tab 18 is bent at slot 18*a*, adjacent web 14, into contact with panel rib 33. Anti-roll tab 18 can be further adjust by bending at slot 18*b*. Anti-roll tab 18 is then attached to existing roof panel 30 with a mechanical fastener. In a preferred embodiment, top flange 16 is positioned up-slope, or toward the ridge, and anti-roll tab 18 faces down slope.

New building panel 40 may then be placed into positioned on top flange 16 of bracket 10. As can be seen in FIGS. 1-5B, the height of bracket 10 defines the distance between existing building panel 30 and new building panel 40. The height of web 12 can be fabricated or adjusted accordingly where a larger or smaller distance between the two building panels is desired, such as where an insulative material or structural hat (32) is to be disposed between the existing roof panel 30 and new building panel 40. Once new building panels 40 are in position on top flange 16 of bracket 10, new fasteners 44 can be driven through new building panel 40 and into bracket 10.

Bracket 10 is shown in FIGS. 1-8 as being generally Z-shaped, with top flange 16 and lower flange 12 parallel with one another and spaced apart by web 14. However, variations to this Z shape are contemplated. For example, web 14 may be angled inwardly or outwardly. Moreover, the size and length of top flange 16 may be varied to provide a larger or smaller surface upon which new building panel 40 will rest. Additionally, a V shape, C shape and other geometries are contemplated. It is preferred, however, that lower flange 12 and top flange 16 be of generally equal width and in a spaced-apart relation It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A bracket comprising:

a web portion having upper and lower edges and a side-facing wall;

a top flange extending outward, at least substantially, along the length of the upper edge of the web portion;

a plurality of pre-defined, downwardly open, recesses formed in the lower edge and side-facing wall of the web portion;

a plurality of bottom flanges connected to, and extending outward from, the lower edges of the web portion between the plurality of pre-defined voids;

at least one securing arm extending from the side-facing wall of the web portion within the recess and between two adjacent bottom flanges.

2. The bracket of claim 1, wherein the web portion is substantially vertical.

3. The bracket of claim 1, wherein the top and bottom flanges are substantially parallel.

4. The bracket of claim 1, wherein the securing arm is integrally formed with the wall of the web portion between the upper and lower edges thereof.

5. The bracket of claim 4, wherein the securing arm further comprises:

a proximate end adjacent the web and a distal end;

a first slot in the proximate end thereof;

a second slot near the distal end thereof; and an aperture for receiving a mechanical fastener between the second slot and the distal end thereof.

6. The bracket of claim 1, wherein the securing arm is attached to the web by a mechanical fastener.

7. A method of retrofitting a standing-seam roof, comprising:

providing at least one bracket comprising:

i. a web portion having upper and lower edges and a substantially side-facing wall, ii. a top flange extending outward along substantially the length of the upper edge of the web portion;

iii. a plurality of pre-defined, downwardly open, recesses formed in the lower edge and wall of the web portion;

iv. a plurality of bottom flanges connected to, and extending outward from, the lower edges of the web portion between the plurality of pre-defined voids;

v. at least one securing arm, having a proximate end connected to the side-facing wall of the web within the recess and a distal end extending outwardly from the side-facing wall and between two adjacent bottom flanges;

positioning the at least one bracket on an existing roof panel, having a base surface connected by raised ribs to a top surface, by nesting the predefined voids of the web portion over the raised ribs and top surface of the existing roof panel;

placing the distal end of the securing arm in contact with the raised rib or top surface of the existing roof panel by bending the securing arm near its proximate end;

affixing the distal end of the securing arm to the raised ribs and top surface of the existing roof panel; positioning at least one new roofing panel on the top flange of the at least one bracket; and securing at least one new building panel to the bracket.

8. The method of claim 7, wherein the bracket is substantially Z-shaped.

9. The method of claim 7, further comprising disposing a layer of insulative material between the at least one existing building panel and the at least one new building panel.

10. A bracket comprising:

a web portion having an upper edge, a lower edge and a side-facing wall;

a top flange extending outward, at least substantially, along the length of the upper edge of the web portion;

a plurality of pre-defined, downwardly open, voids formed in the lower edge and side-facing wall of the web portion;

a plurality of bottom flanges connected to, and extending outward from, the lower edges of the web portion between the plurality of pre-defined voids;

at least one securing arm extending from the side-facing wall of the web portion adjacent at least one of the plurality of pre-defined voids; and the at least one securing arm having a proximate end connected to the side-facing wall of the web at a periphery of one of the predefined voids, and a distal end extending outwardly from the side-facing wall above and between, the adjacent bottom flanges on either side of at least one of the predefined voids when viewed from the top.

11. The bracket of claim 10, wherein the securing arm further comprises:

a proximate end adjacent the web and a distal end;

a first slot in the proximate end thereof;

a second slot near the distal end thereof; and an aperture for receiving a mechanical fastener between the second slot and the distal end thereof.

12. The bracket of claim 10, wherein the securing arm extends from, and is coplanar with, the side-facing wall of the web portion into the predefined void.

13. The bracket of claim 10, wherein the securing arm extends from the side-facing wall of the web portion in substantially the opposite direction as the top flange.

14. The bracket of claim 1, wherein the at least one securing arm extends outwardly from the side-facing wall within at least one of the predefined voids above and between, the adjacent bottom flanges on either side of at least one of the predefined voids when viewed from the top.

* * * * *